US006079999A

United States Patent [19]

Terry et al.

[11] Patent Number: 6,079,999

[45] Date of Patent: Jun. 27, 2000

[54] SINGLE ACTION MECHANICAL/ ELECTRICAL CIRCUIT CARD ENGAGEMENT MECHANISM

[75] Inventors: Andrew M. Terry, Cambridge, Mass.; Edward Steketee, Ft. Collins, Colo.

[73] Assignee: Hewlett-Packard Company, Palo Alto, Calif.

[21] Appl. No.: 09/075,132

[22] Filed: May 8, 1998

[51] Int. Cl.[7] ..... H01R 13/62

[52] U.S. Cl. ..... 439/326

[58] Field of Search ..... 439/326, 289, 439/700, 824, 79, 80

[56] References Cited

U.S. PATENT DOCUMENTS 5,860,825 1/1999 Yodogawa ..... 439/326

*Primary Examiner*—Steven L. Stephan
*Assistant Examiner*—Javaid Nasri

[57] ABSTRACT

A single action card engagement mechanism having a connector block facing locking blocks. The connector block and locking blocks are spaced apart to receive a circuit card. The connector block provides pogo pins in register with card pins on the card. Spring mechanisms tend to push the pogo pins towards the card. At the other end, each locking block has a profile facing the connector block. The profile includes a recess in which the edge of the card is received and retained when the card is located in final position between the connector and locking blocks. In operation, the card pin edge of the card is presented to the connector block. Advantageously aligned using guide pins located on the card received into corresponding guide holes in the connector block, the card pins are moved up to touch the contact heads on the pogo pins. The opposing edge of the card, now resting near the top of the locking block, is now slid along the profile. As the edge of the card slides along the profile, translated motion at the connector block end causes the card pins to depress the pogo pins against their spring mechanisms in a substantially straight line. Eventually, at the locking end, the sliding edge of the card traverses the profile and "clicks" in to the recess. The spring mechanisms of the pogo pins now fulfil the dual function of encouraging good electrical contact at the points of contact between the pogo pins and the card pins, as well as retaining the locking block edge of the card in the recess.

16 Claims, 2 Drawing Sheets

SINGLE ACTION MECHANICAL/ ELECTRICAL CIRCUIT CARD ENGAGEMENT MECHANISM

TECHNICAL FIELD OF THE INVENTION

This invention relates generally to retention mechanisms for circuit cards to be repetitively installed in and removed from, for example, test fixtures, and more specifically to a single action engagement mechanism in which spring-driven pogo pins fulfil a dual function of maintaining good electrical contact between the card pins and the test fixture, as well as helping to retain the card itself in the fixture.

BACKGROUND OF THE INVENTION

It is common in electronic product manufacturing processes to want to test production components on a volume basis. This testing is quite important when the component is a circuit card. The performance of the product (such as a computer or related peripheral) in which the card is to be installed is dependent on accurate processing of signals and data by the circuitry on the card.

Testing of such cards is normally accomplished in a production environment by successively placing cards to be tested in a test fixture. The card connects to test circuitry via the fixture. The card typically makes contact with the test fixture through a connector. This connector is typically a female portion on the test fixture disposed to receive pins located on and extending from the card.

Mechanisms in the prior art to engage the card both physically and electrically in the test fixture suffer from a number of disadvantages. Prior solutions include a fixed male/female connector into which the operator inserts and removes the circuit card assembly. This solution requires excessive forces by the operator, and engagement and release is often accompanied with a back and forth "wiggle" motion which can damage the connector. This damage reduces the life of the female portion of the connector in the test fixture, as well as impairing the pin configuration of the card itself prior to installation in a product. Another prior art solution includes a large linkage mechanism in which is difficult maintain appropriate tolerances and is cumbersome to include in a system solution.

Prior art mechanisms also favor mechanical thumb levers for the operator to release the card. A problem with thumb levers is that if they are not released at the same time, removal of the card can exert a torsional motion on the card that in turn bends the pins on the mating connector. Thumb levers in the prior art also do not necessarily physically engage and hold the card itself. Installing and removing the card from the test thus becomes a two- or three-step process: electrical engagement via a connector held with thumb levers and then physical engagement by other means. This can cause excessive time in a production testing environment to be used just taking one card out of the test fixture and putting another one in.

There is therefore a need in the art for a single action engagement mechanism for inserting and removing cards in and out of housings such as test fixtures. The engagement should be concurrently physical and electrical, advantageously in one motion. The mechanism in operation should cause minimal bending stress to connector pins. The mechanism should also be simple to manufacture and install, while still being reliable over a long maintenance interval.

SUMMARY OF THE INVENTION

These and other objects, features and technical advantages are achieved by a single action card engagement mechanism, which has a connector block facing at least one, and advantageously two locking blocks. The connector block and locking blocks are spaced at the correct distance apart to receive a card. The connector block provides pogo pins in register with the card pins in the card. Spring mechanisms located within the connector block tend to push the pogo pins towards the card so as to encourage contact with the card pins.

At the other end, each locking block has a profile facing the connector block. The profile includes a recess in which the edge of the card is received and retained when the card is located in final position between the connector and locking blocks.

In operation, one edge of the card (the edge from which the card pins extend) is presented to the connector block. Advantageously aligned using guide pins located on the card received into corresponding guide holes in the connector block, the card pins are moved up to touch the contact heads on the pogo pins. The opposing edge of the card, now resting near the top of the locking block, is now pushed down the profile. The profile advantageously further includes a chamfer leading up to the recess and a nib guarding entry into the recess. As the edge of the card slides down the chamfer, translated motion at the connector block end causes the card pins to depress the pogo pins against their spring mechanisms in a substantially straight line, alignment maintained by the guide pins entering further into the guide holes. Eventually, at the locking end, the sliding edge of the card traverses the chamfer, rides over the nib, and "clicks" in to the recess. The spring mechanisms of the pogo pins now fulfil the dual function of encouraging good electrical contact at the points of contact between the pogo pins and the card pins, as well as retaining the locking block edge of the card in the recess.

Removal of the card is simply a reverse operation. Release is achieved by prying the locking block edge of the card gently out of the recess and over the nib, and then allowing the card to traverse back along the chamfer. The corresponding translated motion at the connector block end draws the card pins away in a substantially straight line from contact with the pogo pins. Retraction of the guide pins from the guide holes assists control of this translated motion.

It will be appreciated that interchange of cards according to the inventive mechanism substantially reduces the bending stresses that may be suffered by the card pins. The translated motion at the connector block end, as assisted by the guide pins, is substantially reciprocating and generates minimal rotation of the card about the card pin edge. The effects of the minimal rotation that does occur are further minimized, and even put to good use, by the nature of the pin-to-pin contact between pogo pins and card pins as enabled by the invention. Whatever local rotation at the connector block end is caused by sliding the locking block edge of the card along the profile translates into displacement between the pogo pins and the card pins at their points of contact. This displacement tends to release any bending moments on the card pins, as well as tending to scrape impurities off the surfaces at the point of contact (which in turn enhances electrical contact).

It is therefore a technical advantage of the present invention to provide a single action card engagement mechanism to minimize bending stresses on connector pins extending from circuit cards when repeatedly installing them and removing them from, for example, test fixtures. Minimizing these bending stresses improves the working life of the card connector.

It is a further technical advantage of the present invention to engage the pins on the card electrically without creating a "tight fit" for the card pins. Such "tight fits" inevitable encourage "wiggling" of the card in installing and removing it from a receiving fixture. This "wiggling" exerts destructive bending stresses on the card pins.

It is a still further technical advantage of the present invention to insert and remove cards from, for example, test fixtures in a motion that requires essentially one, straightforward continuous motion. The action of the spring-driven pogo pins in the inventive mechanism in concert with the operator's sliding of the card edge down the profile on the locking blocks enables capture of the card and electrical engagement on the pins in one motion. This is in contrast to the several steps or motions typically required by mechanisms of the prior art.

It is a yet further technical advantage of the present invention to extend the maintenance interval of housings repeatedly receiving and releasing interchangeable cards. Typically, current art connector mechanisms without pogo pins are rated for about 500 cycles. In contrast, pogo pin units can be rated to over a million cycles. Moreover, if required, pogo pins in the inventive mechanism can easily be replaced individually if required. Often, in current art connector mechanisms, if one pin-to-pin contact fails, an entire block of contacts must be replaced.

Another technical advantage of the invention is that it is scalable.

A further technical advantage of the invention is that it is, in comparison to prior art systems, relatively simple and inexpensive to build and deploy. The inventive mechanism is also compact. This is an advantage where physical space is at a premium, or in thermal testing applications where mass of the testing fixture is a concern.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE INVENTION

Figure 1:
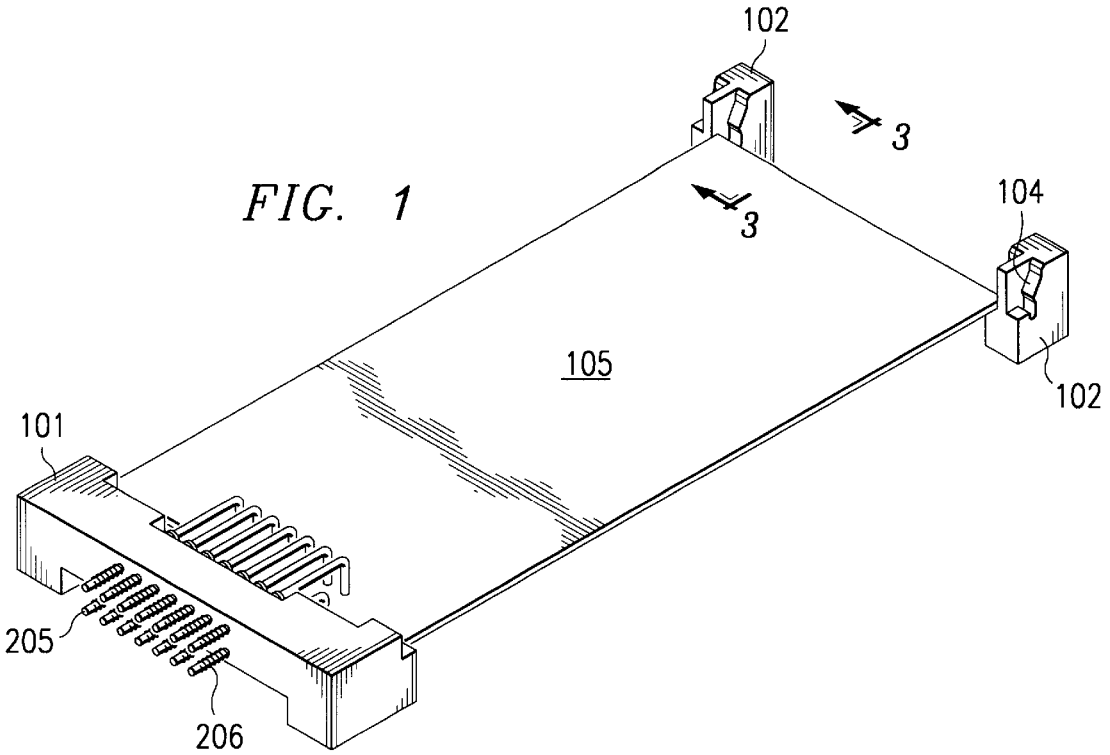
FIG. 1 is a perspective view of card 105 received between connector block 101 and locking blocks 102.

FIG. 1 illustrates connector block 101 and locking blocks 102 holding card 105 in accordance with the inventive mechanism. Typically, connector block 101 and locking block 102 are located on a structure such as a test fixture in which card 105 is one of many required to be inserted and removed from the location shown in FIG. 1. FIG. 1 further illustrates locking interfaces 104 on locking blocks 102, which will be described more fully below with reference to FIG. 3.

The rear sides of pogo pins 205 are also shown on FIG. 1, protruding from the back of connector block 101. It will be appreciated that although only fourteen pogo pins 205 are illustrated on FIG. 1 and other figures, intervening pogo pins 205 in a preselected configuration are omitted for clarity. FIG. 1 also shows coil springs 206 engaging pogo pins 205. The depiction of springs 206 as shown on FIG. 1 is for illustrative purposes only, representing a spring mechanism tending to encourage pogo pins 205 towards card 105 within connector block 101. Minor details of the spring mechanism are omitted for clarity. It will be appreciated that any spring mechanism capable of providing such encouragement is enabling, and the invention is not limited to any specific spring mechanism details.

Figure 2:
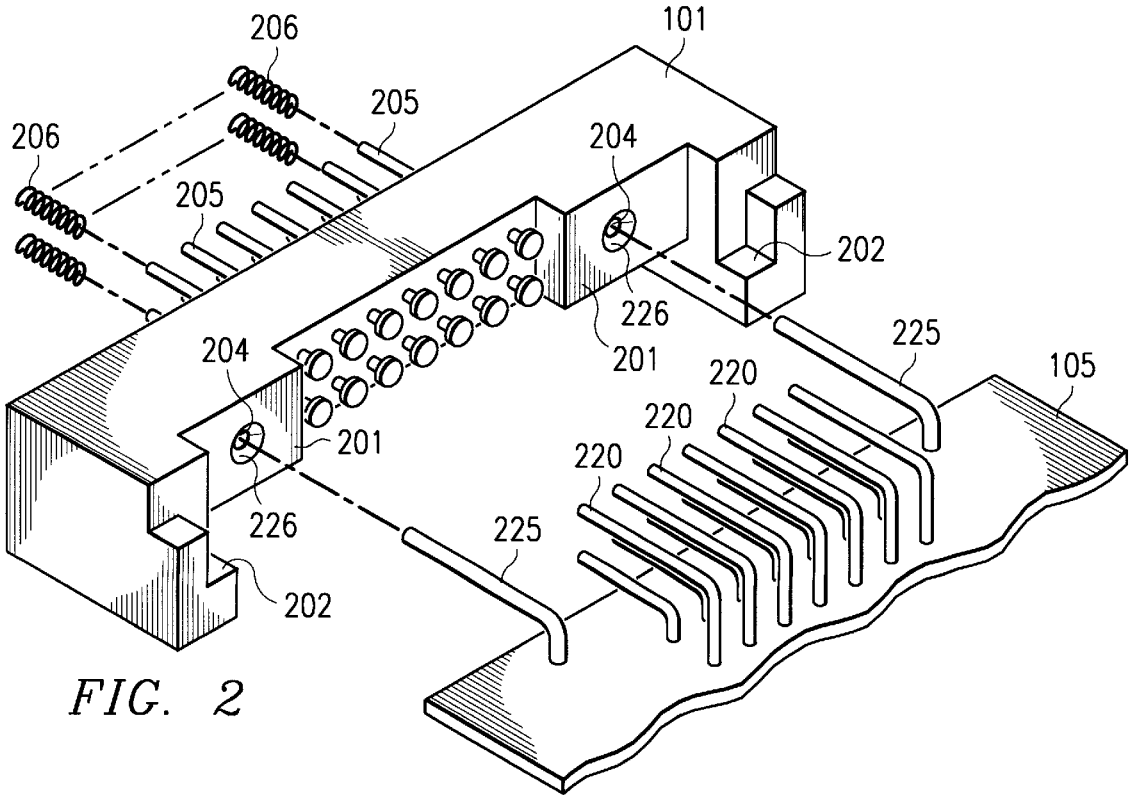
FIG. 2 is an exploded view of card 105 being received into connector block 101.

Turning now to FIG. 2, an exploded view is illustrated where card 105 is being brought up to engage connector block 101 at connector interface 201. Card pins 220 are in register with pogo pins 205 so that each card pin makes concurrent contact with a corresponding pogo pin. Advantageously, guide pins 225 are initially received into guide holes 204, to assist in full concurrent engagement of card pins 220 and corresponding pogo pins 205. The effectiveness of guide pins 225 is further enhanced by countersinks 226 on guide holes 204.

Figure 3:
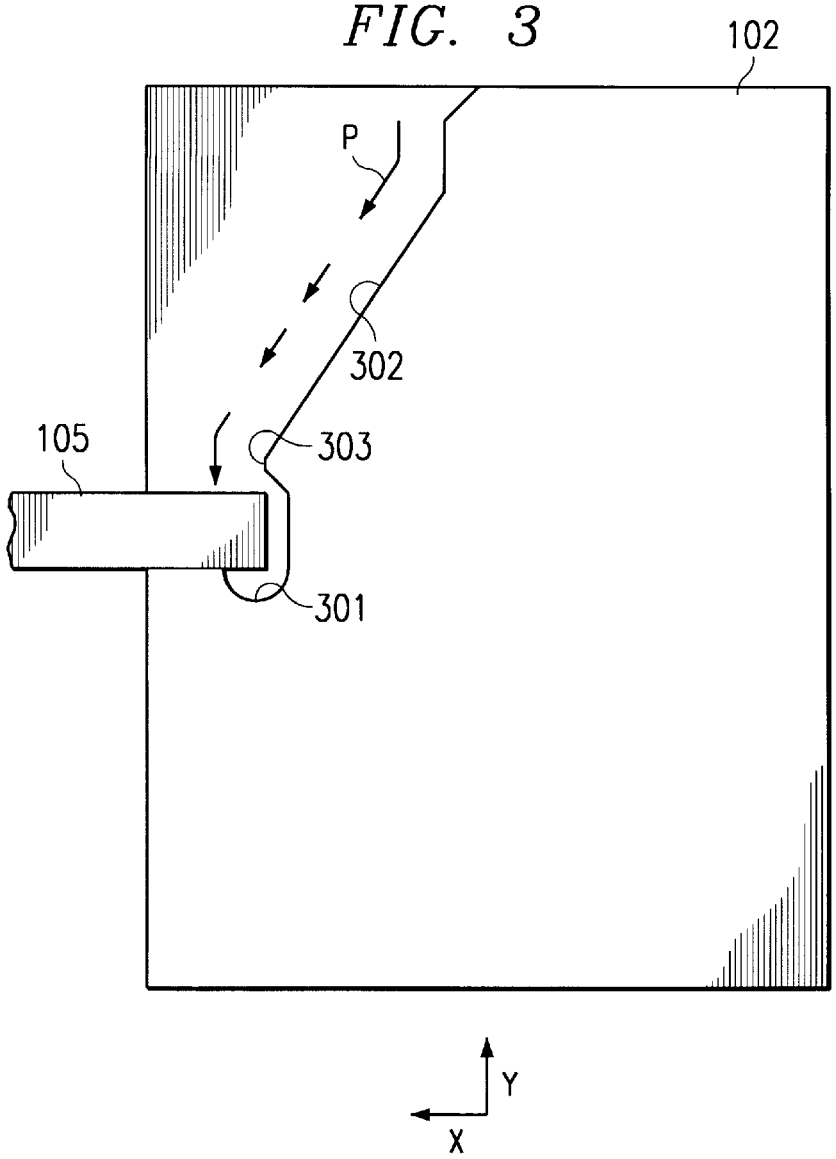
FIG. 3 is a section view of locking block 102 as shown on FIG. 1.

FIG. 3 is a section view of locking block 102 as shown on FIG. 1, and depicts card 105 as received into locking block 102. For purposes of discussion of FIG. 3 in combination with FIG. 2, "x" and "y" directions are as shown on FIG. 3. To install card 105, guide pins 225 on FIG. 2 are received into guide holes 204 (if guide pins and holes are provided), and the opposing edge of card 105 is slid down path P as shown in FIG. 3. As the edge of card 105 is slid down path P on FIG. 3, its traverse of chamfer 302 causes translation motion of card 105 in the "x" direction, towards connector block 101 as shown on FIG. 2. Referring now to FIG. 2, this translation motion causes card pins 220 to engage pogo pins 205 and to compress springs 206. This spring action enables electrical contact between pogo pins 205 and card pins 220. Returning now to FIG. 3, continued traverse of path P causes the edge of card 105 to encounter recess 301, advantageously guarded by nib 303. Slight additional pressure causes the edge of card 105 to "click" into recess 301, held there by spring pressure from pogo pins 205 making contact with card pins 220 at the other end of the card.

With further reference to FIG. 3, release of card 105 is achieved by reversing the process. The edge of card 105 is "popped" out of recess 301, typically using finger and thumb action by the operator. Spring pressure from pogo pins 205 engaging card pins 220 at the other end of card 105 causes the edge of card 105 to traverse back up chamfer 302 until the card 105 may be extracted by withdrawing guide pins 225 from guide holes 204 (if guide pins and holes are provided).

Figure 4:
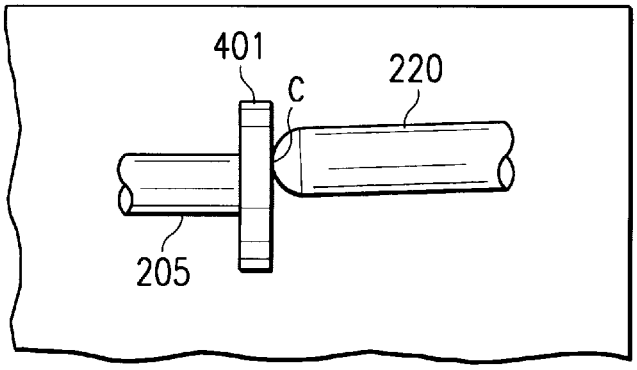
FIG. 4 details pin-to-pin contact according to a preferred embodiment.

FIG. 4 depicts pin-to-pin contact in a preferred embodiment. Pogo pins 205 advantageously have heads 401 opposing card pins 220. Experimentation has shown that a curvature diameter of 15–20 thousands of an inch on the end of card pins 220 is advantageous. This arrangement enables good pin-to-pin contact C, as shown on FIG. 4. Pogo pin heads 401 are also advantageously larger than card pins 220. This allows for good pin-to-pin contact C even when pins are slightly misaligned.

The inventive mechanism enables yet further enhanced pin-to-pin contact via a "scraping" or "wiping" action between heads. Referring momentarily to FIG. 3, motion of the edge of card 105 down path P in the "y" direction will be seen to cause a slight moment about the opposing edge of card 105. This moment is relieved by a small displacement of point of contact C on FIG. 4. This small displacement, coupled with the spring pressure forcing the pin heads together, causes a "wiping" or "scraping" action tending to remove surface impurities from the point of contact C. Electrical contact is thereby enhanced.

While FIG. 4 illustrates pogo pins 205 with enlarged heads 401, it will be appreciated that pogo pins 205 may also be simply provided larger in diameter (without enlarged heads) with equivalent enabling effect.

It will also be appreciated that the inventive mechanism is completely scalable. The principles of the invention may be enabled on just about any number of card pins in just about any configuration on any size card. Further, the invention is not limited to the exemplary card and test fixture application described above. The invention is operable upon any item having opposing edges and a pin configuration to be connected at one end.

Although the present invention and its advantages have been described in detail, it should be understood that various changes, substitutions and alterations can be made herein without departing from the spirit and scope of the invention as defined by the appended claims.

We claim:

1. A single action card engagement mechanism, comprising:

a proximal connector block opposing at least one distal locking block, the connector block including a connector interface facing distally, each locking block including a locking interface facing proximally, the connector and the locking interfaces spaced apart so as to concurrently receive opposing proximal and distal edges of a circuit card, the card having card pins extending towards the connector interface from the proximal edge thereof;

the connector interface including a separate pogo pin matched to each card pin wherein the card pins and the corresponding pogo pins are in register, each pogo pin having a contact surface opposing its corresponding card pin, each pogo pin further encouraged by a spring mechanism to maintain electrical contact between its contact surface and its corresponding card pin when the card is received between the connector and the locking interfaces; and each locking interface including a profile facing the connector interface, the profile including a recess, wherein sliding of the distal edge of the card along the profile and into the recess translates into motion of the proximal edge of the card towards the connector interface so as to cause spring-encouraged engagement of the pogo pins by the card pins, said spring-encouraged engagement further encouraging retention of the distal edge of the card in the recess.

2. The single action card engagement mechanism of claim 1, in which the profile further includes a chamfer leading up to the recess, the chamfer describing said translated motion of the proximal edge of the card towards the connector interface when the distal edge of the card is slid along the profile.

3. The single action card engagement mechanism of claim 1, in which the profile further comprises a nib guarding entry into the recess, and in which the nib discourages exit by the distal end of the card from said retention in the recess.

4. The single action card engagement mechanism of claim 1, in which the card further includes guide pins extending towards the connector interface from the proximal edge thereof;

the connector interface further including guide holes disposed to receive the guide pins when the card is received between the connector and the locking interfaces, reception of the guide pins in the guide holes causing the card pins to be aligned in register with their corresponding pogo pins.

5. The single action card engagement mechanism of claim 4, in which the guide holes are countersunk.

6. The single action card engagement mechanism of claim 1, in which the card pins are rounded in a convex shape at their points of contact with the contact surfaces of the pogo pins.

7. The single action card engagement mechanism of claim 6, in which the convex shapes of the card pins have a diameter in the range of 15 to 20 thousandths of an inch.

8. The single action card engagement mechanism of claim 1, in which said sliding of the distal edge of the card along the profile further translates into local displacement of points of contact between the card pins and their corresponding contact surfaces, said displacement tending to release bending moments exerted on the card pins by said sliding, said displacement further tending to scrape surface impurities from the points of contact and thereby enhancing electrical contact therebetween.

9. A single action card engagement mechanism, comprising:

a proximal connector block opposing at least one distal locking block, the connector block including a connector interface facing distally, each locking block including a locking interface facing proximally, the connector and the locking interfaces spaced apart so as to concurrently receive opposing proximal and distal edges of a circuit card, the card having card pins extending towards the connector interface from the proximal edge thereof;

the connector interface including a separate pogo pin matched to each card pin wherein the card pins and the corresponding pogo pins are in register, each pogo pin having a contact surface opposing its corresponding card pin, each pogo pin further encouraged by a spring mechanism to maintain electrical contact between its contact surface and its corresponding card pin when the card is received between the connector and the locking interfaces;

each locking interface including a profile facing the connector interface, the profile including a chamfer leading up to a nib guarding entry into a recess, wherein sliding of the distal edge of the card along the chamfer, over the nib and into the recess causes translation motion of the proximal edge of the card towards the connector interface, said translated motion described by the chamfer, said translated motion causing spring-encouraged engagement of the pogo pins by the card pins, said spring-encouraged engagement further encouraging retention of the distal edge of the card in the recess, exit from said retention discouraged by the nib;

said sliding of the distal edge of the card along the chamfer further translating into local displacement of points of contact between the card pins and their corresponding contact surfaces on the pogo pins, said displacement tending to release bending moments exerted on the card pins by said sliding, said displacement further tending to scrape surface impurities from the points of contact and thereby enhancing electrical contact therebetween;

the card further including guide pins extending towards the connector interface from the proximal edge thereof; and the connector interface further including countersunk guide holes disposed to receive the guide pins when the card is received between the connector and the locking interfaces, reception of the guide pins in the guide holes causing the card pins to be aligned in register with their corresponding pogo pins.

10. The single action card engagement mechanism of claim 9, in which the card pins are rounded in a convex shape at their points of contact with the contact surfaces of the pogo pins.

11. The single action card engagement mechanism of claim 10, in which the convex shapes of the card pins have a diameter in the range of 15 to 20 thousandths of an inch.

12. A method for receiving and retaining an interchangeable circuit card in a test fixture while minimizing bending stresses on card pins extending therefrom, the method comprising:

(a) deploying a proximal connector block on the test fixture to oppose at least one distal locking block on the test fixture, the connector block including a connector interface facing distally, each locking block including a locking interface facing proximally, the connector and the locking interfaces spaced apart so as to concurrently receive opposing proximal and distal edges of a circuit card, the card having card pins extending towards the connector interface from the proximal edge thereof, the connector interface including a separate pogo pin matched to each card pin wherein the card pins and the corresponding pogo pins are in register, each pogo pin having a contact surface opposing its corresponding card pin, each pogo pin further encouraged by a spring mechanism to maintain electrical contact between its contact surface and its corresponding card pin when the card is received between the connector and the locking interfaces, each locking interface including a profile facing the connector interface, the profile including a chamfer leading up to a recess; and (b) sliding the distal edge of the card along the chamfer and into the recess so as to cause translation motion of the proximal edge of the card towards the connector interface, said translated motion described by the chamfer, said translated motion causing spring-encouraged engagement of the pogo pins by the card pins, said spring-encouraged engagement further encouraging retention of the distal edge of the card in the recess.

13. The method of claim 12, in which step (b) further translates into local displacement of points of contact between the card pins and their corresponding contact surfaces on the pogo pins, said displacement tending to release bending moments exerted on the card pins by step (b), said displacement further tending to scrape surface impurities from the points of contact and thereby enhancing electrical contact therebetween.

14. The method of claim 12, in which the profile further comprises a nib guarding entry into the recess, and in which the nib discourages exit by the distal end of the card from said retention in the recess.

15. The method of claim 12, in which the card further includes guide pins extending towards the connector interface from the proximal edge thereof, the connector interface further including guide holes disposed to receive the guide pins when the card is received between the connector and the locking interfaces, reception of the guide pins in the guide holes causing the card pins to be aligned in register with their corresponding pogo pins.

16. The method of claim 12, in which the card pins are rounded in a convex shape at their points of contact with the contact surfaces of the pogo pins.

* * * * *